US006516549B1

(12) United States Patent
Hildebrandt et al.

(10) Patent No.: US 6,516,549 B1
(45) Date of Patent: Feb. 11, 2003

(54) MUZZLE-LOADING FIREARM

(75) Inventors: Carl B. Hildebrandt, Springfield, MA (US); Charles W. Hodgdon, Greenfield, MA (US); Ronald Coburn, Spofford Lake, NH (US); Lee Cavanaugh, Winchester, CT (US); Yasmine A. Adham, Springfield, MA (US); Daniel Borecki, Belchertown, MA (US); Henry C. Ball, Greensboro, NC (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 09/873,485

(22) Filed: Jun. 4, 2001

(51) Int. Cl.[7] ..... F41C 9/08
(52) U.S. Cl. ..... 42/51; 42/83; 89/1.3
(58) Field of Search ..... 42/16, 51, 83; 89/1.3, 27.13

(56) References Cited

U.S. PATENT DOCUMENTS

| | | | | | |
|---|---|---|---|---|---|
| 2,030,149 | A | * | 2/1936 | Mossberg | 42/16 |
| 3,780,464 | A | | 12/1973 | Anderson | 42/69 |
| 4,222,191 | A | | 9/1980 | Lee et al. | 42/77 |
| 4,227,330 | A | | 10/1980 | Chapin | 42/77 |
| 4,232,468 | A | | 11/1980 | Chapin | 42/77 |
| 4,283,874 | A | | 8/1981 | Vaughn | 42/51 |
| 4,437,249 | A | | 3/1984 | Brown et al. | 42/51 |
| 4,700,499 | A | | 10/1987 | Knight | 42/51 |
| 4,715,139 | A | | 12/1987 | Rodney, Jr. | 42/51 |
| 4,912,868 | A | | 4/1990 | Thompson | 42/77 |
| 5,010,677 | A | | 4/1991 | Verney Carron | 42/77 |
| 5,109,622 | A | | 5/1992 | Echeberria | 42/69.02 |
| 5,133,143 | A | * | 7/1992 | Knight | 42/51 |
| 5,307,583 | A | | 5/1994 | Mahn et al. | 42/51 |
| 5,408,776 | A | | 4/1995 | Mahn et al. | 42/51 |
| 5,435,089 | A | * | 7/1995 | Rodney, Jr. | 42/51 |
| 5,487,232 | A | | 1/1996 | Osborne et al. | 42/51 |
| 5,511,334 | A | | 4/1996 | Ball et al. | 42/51 |
| 5,519,955 | A | * | 5/1996 | Peifer | 42/51 |
| 5,561,934 | A | * | 10/1996 | Knight | 42/51 |
| 5,606,817 | A | * | 3/1997 | Sachse | 42/51 |
| 5,623,779 | A | * | 4/1997 | Rainey, III | 42/51 |
| 5,642,583 | A | | 7/1997 | Ball et al. | 42/51 |
| 5,651,203 | A | * | 7/1997 | Knight | 42/25 |
| 5,706,598 | A | | 1/1998 | Johnston | 42/51 |
| 5,718,073 | A | * | 2/1998 | Sachse et al. | 42/16 |
| 5,860,240 | A | | 1/1999 | Ball et al. | 42/51 |
| 5,907,920 | A | | 6/1999 | Laney | 42/83 |

FOREIGN PATENT DOCUMENTS

| | | | | |
|---|---|---|---|---|
| NO | Nr. 54568 | * | 10/1934 | 42/51 |

OTHER PUBLICATIONS

Knight Rifles; photocopy of brochure—undated.
Webster's II New Riverside Unversity Dictionary, Riverside Publishing, p. 420.

* cited by examiner

*Primary Examiner*—Michael J. Carone
*Assistant Examiner*—Gabriel S. Sukman
(74) *Attorney, Agent, or Firm*—MacCord Mason PLLC

(57) ABSTRACT

A muzzle-loading firearm is disclosed. In the preferred embodiment, the muzzle-loading firearm includes a receiver having a locking mechanism; a barrel having a breech end, a bore and a muzzle end; a primer carrier for transporting a primer to the breech end of the barrel prior to firing and for extracting the primer from the breech end of the barrel after firing; and a breech plug in the breech end of the barrel, wherein the breech plug receives the primer from the primer carrier. In the preferred embodiment, the primer carrier includes a horseshoe-shaped primer holder attached to the locking mechanism.

66 Claims, 6 Drawing Sheets

MUZZLE-LOADING FIREARM

BACKGROUND OF THE INVENTION (1) Field of the Invention

The present invention relates generally to firearms and, more particularly, to an improved muzzle-loading firearm having a primer carrier for transporting a primer to the breech end of the barrel prior to firing and for extracting the primer from the breech end of the barrel after firing.

(2) Description of the Prior Art

Modern breech-loading firearms, such as rifles, include a barrel having an axial bore, a stock to support the barrel, and a receiver at the breech end of the barrel. The receiver is comprised of a housing which includes a chamber for insertion of a cartridge into the breech of the barrel, a means for firmly securing the cartridge in the breech of the barrel in a sealed and locked position, a firing pin to discharge the cartridge primer, a trigger to move the firing pin into engagement with the cartridge primer, and an ejector to remove the cartridge after firing.

Muzzle-loading rifles and other muzzle-loading firearms are also comprised of a barrel with an axial bore and a supporting stock. However, a muzzle-loading rifle is loaded by inserting a charge of powder, wadding and shot through the muzzle end of the barrel and tamping the charge securely into the breech end of the barrel. The powder is then ignited, e.g., by striking a percussion cap, which sends a flame, normally through a small opening or flame bore, into the breech of the barrel through a breech plug which separates the primer from the powder charge.

Muzzle-loading rifles have several disadvantages in comparison with breech-loading cartridge rifles. They are more difficult and time consuming to load, and require greater skill to use. Malfunctions are more common due to the relatively more complex firing mechanisms required to ignite the powder. Muzzle-loading rifles are affected by inclement weather, particularly rain and moisture which affects the powder and causes the rifle to misfire. Muzzle-loading rifles must also be cleaned thoroughly to prevent clogging and corrosion by the powder residue.

Despite these disadvantages, many hunters and firearms enthusiasts prefer to use muzzle-loading firearms, at least on some occasions, due to the nostalgia and the sport which the muzzle-loaders afford. In addition, many states allow a longer hunting season and special hunting areas for muzzle-loading firearms, due to the greater challenge provided and, consequently, the much smaller number of animals taken.

Various designs have been proposed for the construction of improved muzzle-loading rifles. For example, U.S. Pat. No. 4,700,499 to Knight discloses a muzzle-loading rifle that uses a "nut cracker" type of action to fire a conventional percussion cap. U.S. Pat. No. 3,780,464 to Anderson and U.S. Pat. No. 4,283,874 to Vaughan disclose mechanisms for replacing the flash hole structure in breech or muzzle-loading firearms to allow firing with modern metallic cartridge primers. Both inventions use a cap covering to hold the primer in place until firing.

U.S. Pat. Nos. 4,227,330 and 4,232,468 to Chapin disclose a conversion plug that can be configured to be removably inserted into the breech of a breech-loading firearm to convert the firearm into a muzzle-loading type. The conversion plug includes a primer cap-receiving chamber which communicates with the bore of the rifle through a flash hole.

U.S. Pat. No. 4,222,191 to Lee et al.; U.S. Pat. No. 4,437,249 to Brown et al.; and U.S. Pat. No. 5,010,677 to Carron all disclose variations of the Chapin type of conversion plug for converting a shotgun or rifle into a muzzle-loader.

U.S. Pat. Nos. 5,511,334 and 5,642,583, issued to Ball et al., disclose a way to convert a modern breech lock, cartridge rifle into a rifle that can be used as a muzzle-loading rifle. The disclosures of these patents are hereby incorporated by reference in their entirety. However, even in this design the flame bore extending through the breech plug can become clogged or corroded after repeated use. This may require that the entire breech plug be replaced at some expense.

U.S. Pat. No. 6,176,030 issued to Ball discloses an improved muzzle-loading firearm which is achieved by modifying the design of the breech plug to include a replaceable aperture adjacent to the firing chamber which can be easily replaced if damaged beyond repair. The disclosure of this patent is hereby incorporated by reference in its entirety. This patent discloses a breech plug adapted to receive an ejectable firing module such as disclosed in the above-referenced Ball patents. The firing module permits loading of the firearm as a muzzle-loader, while also permitting the firing module to be inserted and ejected like a cartridge in a conventional breech-loading firearm. This firing module breech plug design greatly simplifies the insertion and removal of a primer from the firearm.

However, though the ease of inserting and removing the firing module in such muzzle-loading firearms has proved to be a vast improvement over prior muzzle-loading rifles, the improvement has at least one shortcoming in practice. The modern bolt design and possibility for conversion of such a weapon to a center-fire rifle may affect the classification of such a firearm under federal statute 18 U.S.C. Section 921(a)(3)(A). While the sale and transport of modern firearms is subject to strict regulation by the BATF, so-called "primitive weapons" are not so strictly regulated. Therefore, firearms having a removable firing module feature may cause such weapons to be classified as a modern firearm and thereby subject such weapons to costly and rigorous regulatory requirements.

Thus, there remains a need for a new and improved muzzle-loading firearm in which a conventional primer can be quickly and easily inserted and removed from the firearm while, the same time, also satisfying the BATF's requirements as a "primitive weapon."

SUMMARY OF THE INVENTION

The present invention is directed to a muzzle-loading firearm. In the preferred embodiment, the muzzle-loading firearm includes a receiver having a locking mechanism; a barrel having a breech end, a bore and a muzzle end; a primer carrier for transporting a primer to the breech end of the barrel prior to firing and for extracting the primer from the breech end of the barrel after firing; and a breech plug in the breech end of the barrel, wherein the breech plug receives the primer from the primer carrier. In the preferred embodiment, the primer carrier includes a horseshoe-shaped primer holder attached to the locking mechanism.

In the preferred embodiment, the breech plug further includes a nippleless primer-receiving chamber and a flame bore extending from the chamber into the bore of the barrel. The chamber of the breech plug may further include an outwardly extending primer collar on the breech plug which is radially symmetrical for random matching with the primer carrier. The primer collar may include a chamfered end on the outwardly extending primer collar which also is radially symmetrical for random matching with the primer carrier.

In the preferred embodiment, the flame bore may include a replaceable vent liner and the breech plug may include a vent liner thread-protecting seal. The breech plug is threaded for engagement with the barrel and may include a breech plug thread protecting seal. The breech plug also may further include an installation tool-mating surface.

Also, in the preferred embodiment, receiver further includes a protective shroud which may include one or more safety vent holes. In addition, the receiver may further includes a cocking indicator.

The locking mechanism includes a bolt, a bolt handle and a slot in the receiver for locking the bolt in a firing position. Preferably, the muzzle end of the barrel further includes a muzzle back bore of sufficient depth to provide engagement with the rear portion of a bullet inserted into the muzzle end of the barrel while, at the same time, is sufficiently shallow to permit inspection of the front surface of the bullet inserted into the muzzle end of the barrel.

In the preferred embodiment, the horseshoe-shaped primer holder includes a chamfered edge for mating with the breech plug collar. Preferably, the horseshoe-shaped primer holder includes an open end oriented about forty-five degrees above horizontal in a loading position and about forty-five degrees below horizontal in a firing position.

The primer carrier may further include an alignment guide for aligning the primer carrier within the receiver. The alignment guide includes a cam means for presetting the primer at a firing position and the locking mechanism further includes a closing cam for setting the primer at a firing position and relieving pressure on the rear action screw in the receiver. In addition, the alignment guide may further include a backstop for limiting the rearward motion of the primer carrier in the receiver. The locking mechanism also includes an extraction cam which cooperates with the primer carrier for extracting the primer after firing.

The present invention takes advantage of the structural strength of a modern breech-loading firearm to allow the use of smokeless powder as well as black powder or artificial black powder substitutes. Thus, the muzzle-loader rifle of the present invention is comprised of a barrel into which powder is inserted into the muzzle. A plastic sabot containing a bullet, a round ball and patch, or a lead or non-lead bullet with or without a plastic sabot is then loaded into the barrel. The rifle can then be discharged in a conventional manner. The breech end of the barrel may be adapted to receive a conventional 209 shotgun primers. The forward end of the breech plug is designed to accept the 209 shotgun primer and form a seal with the bolt face. The length of the chamber has sufficient depth to accept the 209 shotgun firing primer.

Accordingly, one aspect of the present invention is to provide a muzzle-loading firearm. The firearm includes a breech-loading receiver including a locking mechanism moveable between an open position and a locked position, a barrel having a breech end engaging the receiver, and a bore extending from the breech end for receiving a powder charge and accepting a 209 shotgun primer insertable within the breech end of the barrel.

Accordingly, one aspect of the present invention is to provide a muzzle-loading firearm, the muzzle-loading firearm including: a receiver having a locking mechanism; a barrel having a breech end, a bore and a muzzle end; and a primer carrier for transporting a primer to the breech end of the barrel prior to firing and for extracting the primer from the breech end of the barrel after firing.

Another aspect of the present invention is to provide an improved muzzle-loading firearm having a receiver including a locking mechanism; and a barrel having a breech end, a bore and a muzzle end, wherein the improvement includes: a primer carrier for transporting a primer to the breech end of the barrel prior to firing and for extracting the primer from the breech end of the barrel after firing, the primer carrier including a horseshoe-shaped primer holder attached to the locking mechanism.

Still another aspect of the present invention is to provide a muzzle-loading firearm, the muzzle-loading firearm including: a receiver having a locking mechanism; a barrel having a breech end, a bore and a muzzle end; a primer carrier for transporting a primer to the breech end of the barrel prior to firing and for extracting the primer from the breech end of the barrel after firing, the primer carrier including a horseshoe-shaped primer holder attached to the locking mechanism; and a breech plug in the breech end of the barrel, wherein the breech plug receives the primer from the primer carrier.

These and other aspects of the present invention will become apparent to those skilled in the art after a reading of the following description of the preferred embodiment when considered with the drawings.

DESCRIPTION OF THE PREFERRED EMBODIMENTS

Figure 1:
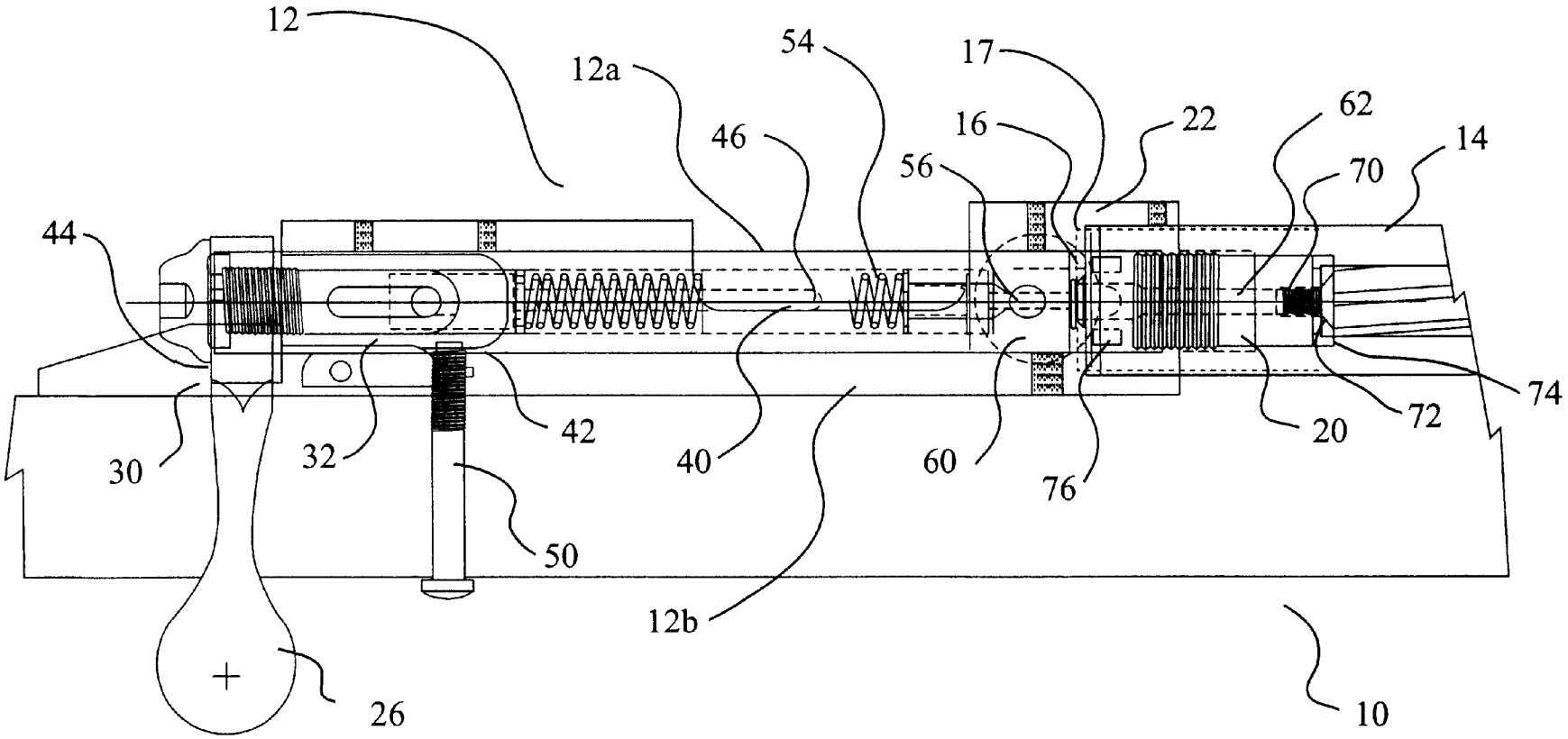
FIG. 1 is a cross-sectional view of a muzzle-loading firearm including a receiver, locking mechanism, barrel, and primer carrier, constructed according to the present invention.

In the following description like reference characters designate like or corresponding parts throughout the several views. Also in the following description, it is to be understood that such terms as "forward," "rearward," "left," "right," "upwardly," "downwardly" and the like are words of convenience and are not to be construed as limiting terms.

Referring now to the drawings in general, and FIG. 1 in particular, it will be understood that the illustrations are for the purpose of describing a preferred embodiment of the invention and are not intended to limit the invention thereto.

In FIG. 1, there is shown a representation of a preferred embodiment of the present invention which is a muzzle-loading rifle 10 including a receiver/locking mechanism 12 and a barrel 14 threaded into the receiver/locking mechanism 12. A bolt 12*a* has a primer carrier 16 which is carried in a receiver 12*b* for loading and extracting primers from the firearm. The primer carrier 16 includes a firing mechanism 54 which includes a firing pin 56. The firing pin 56 has an oversized diameter to better accommodate a blown primer in the firearm. A breech plug 20 is threaded into the breech end of the barrel 14, and has a breech plug thread protecting seal 74.

Figures 2A, 2B:
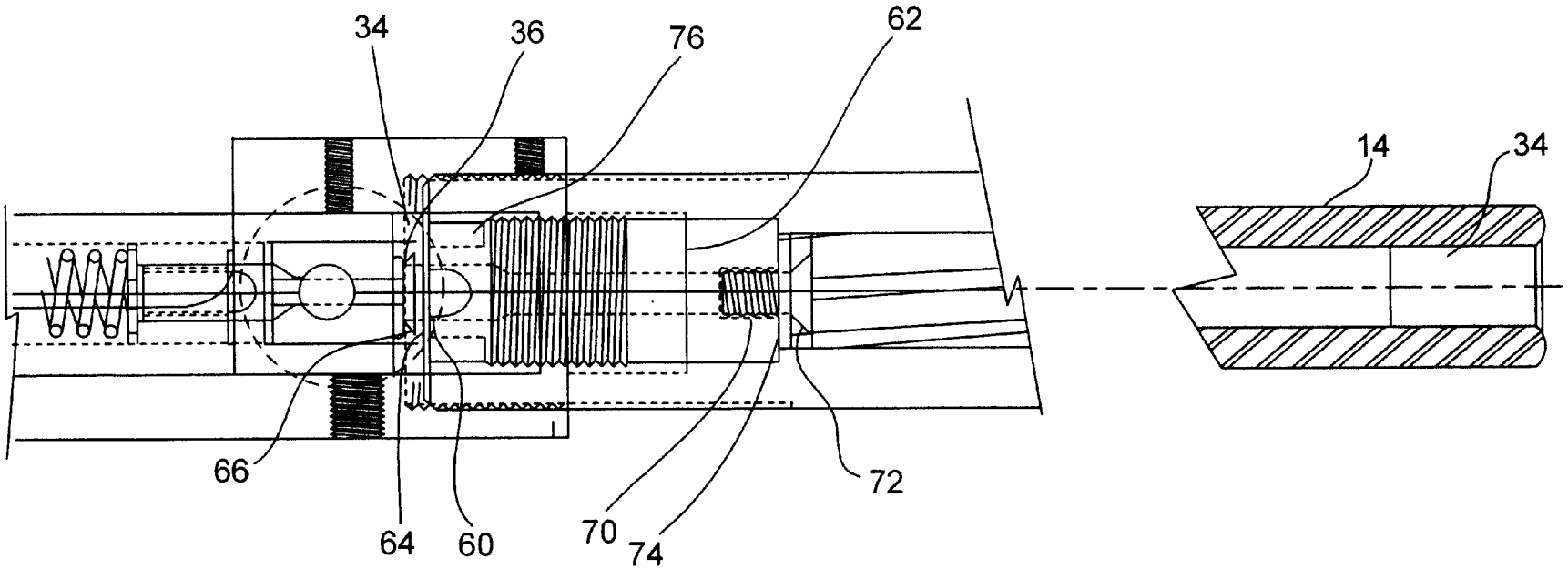
FIG. 2A is an enlarged cross-sectional view of the breech plug portion of the muzzle-loading firearm of FIG. 1.
FIG. 2B is a cross-sectional view of the muzzle end of the barrel of the firearm shown in FIG. 1.

As seen best in FIG. 2A, the breech plug 20 is comprised of a primer receiving chamber 60, a flame bore 62 through the breech plug 20, an outwardly extending primer collar 64, and a primer receiving chamber 66. The flame bore 62 includes a replaceable vent liner 70 which has a thread protecting seal 72. The breech plug 20 also contains an installation tool mating surface 76 for use in installing or removing the breech plug 20 from the barrel 14.

As seen in FIG. 2B, the barrel 14 includes a muzzle back bore 34. The muzzle back bore 34 provides slight additional clearance with a bullet or a bullet and sabot when the bullet is loaded into the muzzle. The back bore 34 is bored sufficiently deep to permit engagement with the bullet when a bullet and sabot are inserted together into the muzzle. The back bore 34 is sufficiently shallow to permit inspection of a bullet before it is rammed into the barrel 14.

Figure 3A:
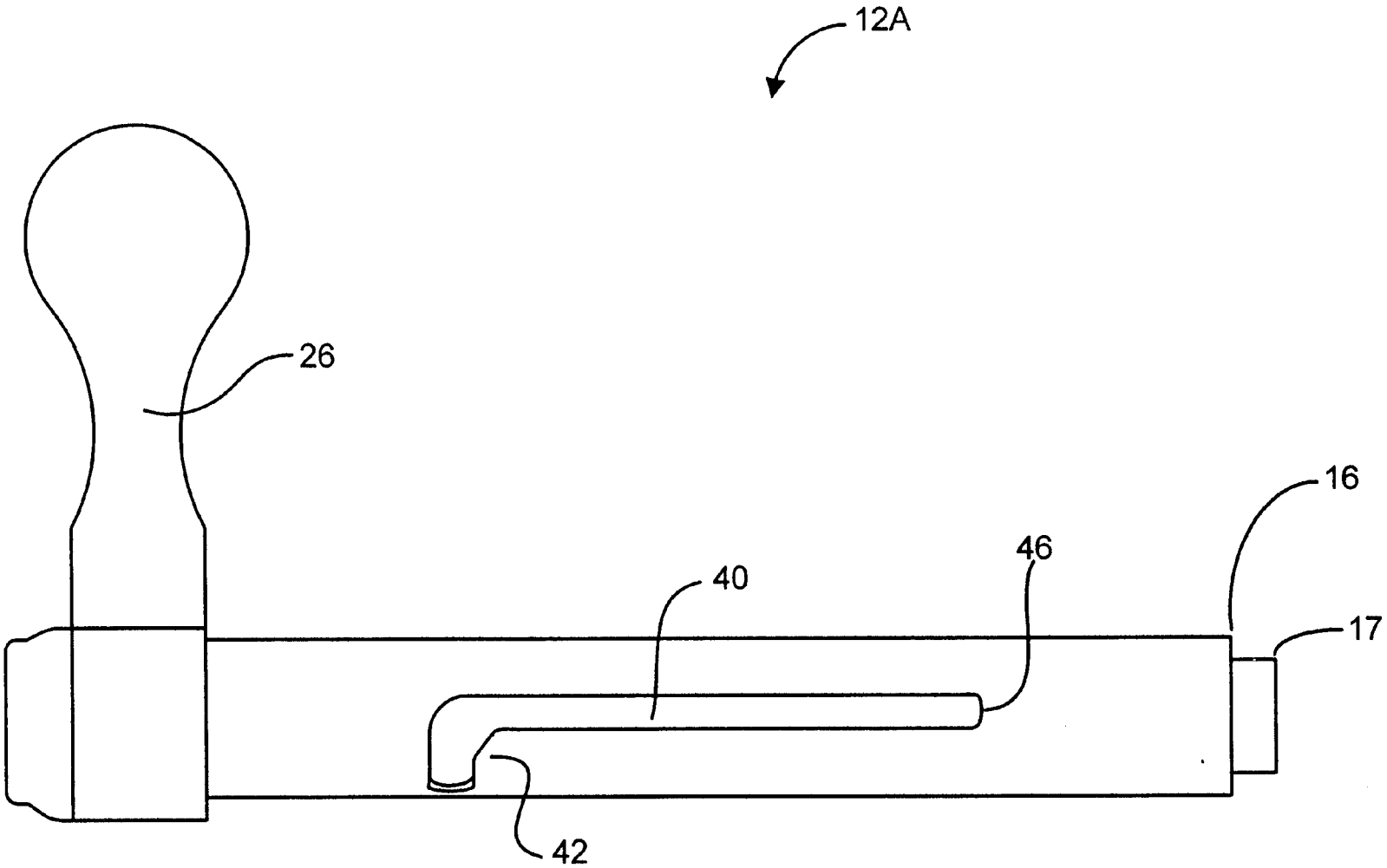
FIG. 3A is a detail view of the primer carrier portion of the firearm shown in FIG. 1, rotated to show the alignment guide.
Figure 3B:
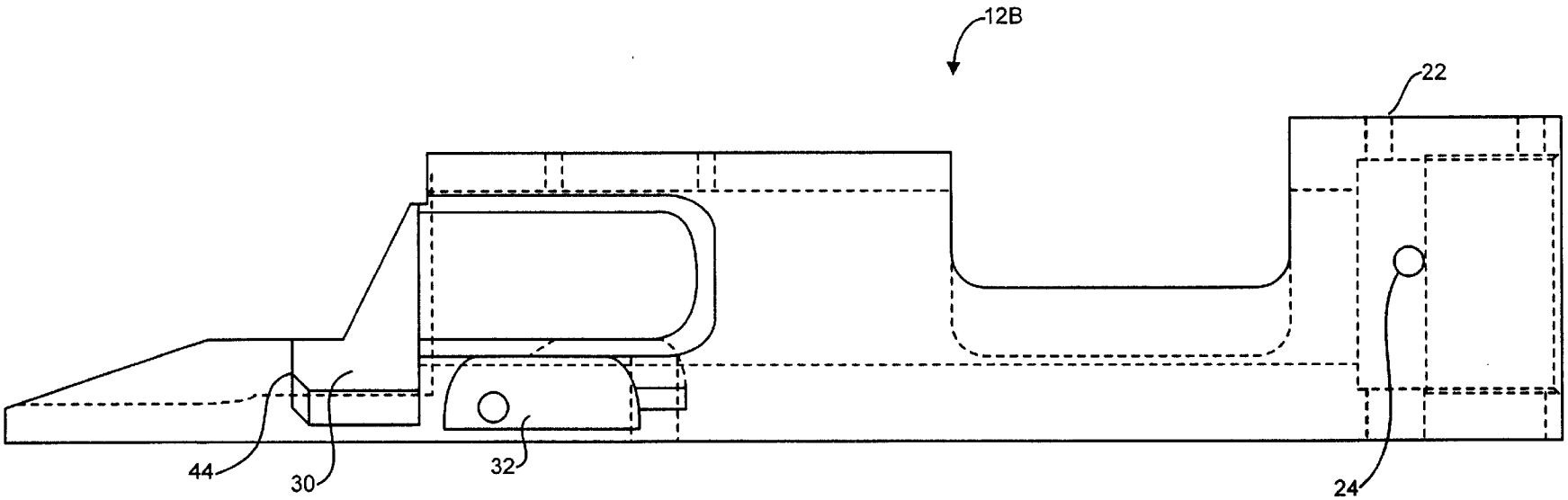
FIG. 3B is a detail view of the receiver portion of the firearm shown in FIG. 1.

Details of the receiver/locking mechanism 12 are best seen in FIGS. 3A and 3B. The receiver/locking mechanism 12 includes a receiver 12*b* and a bolt 12*a*. As seen best in FIG. 3A, the bolt 12*a* has an alignment guide 40 which engages the screw 50 shown in FIG. 1 for aligning the bolt 12*a* in the receiver 12*b*. The alignment guide 40 includes a cam means 42 and a backstop 46. The bolt 12*a* has a bolt handle 26. The bolt handle 26 engages a slot 30 in the receiver 12*b* for locking the locking mechanism 12 in a firing arrangement. As seen best in FIG. 3B and FIG. 1, the receiver 12*b* includes a protective shroud 22 for shielding a user of the firearm from the ignition in the firearm. The protective shroud 22 has one or more safety vent holes 24 for venting any sudden buildup of pressure resulting from a prematurely blown primer in the firearm. A cocking indicator 32 is provided to indicate to a user of the firearm that the firearm has been cocked and has not yet been fired.

Figure 4A:
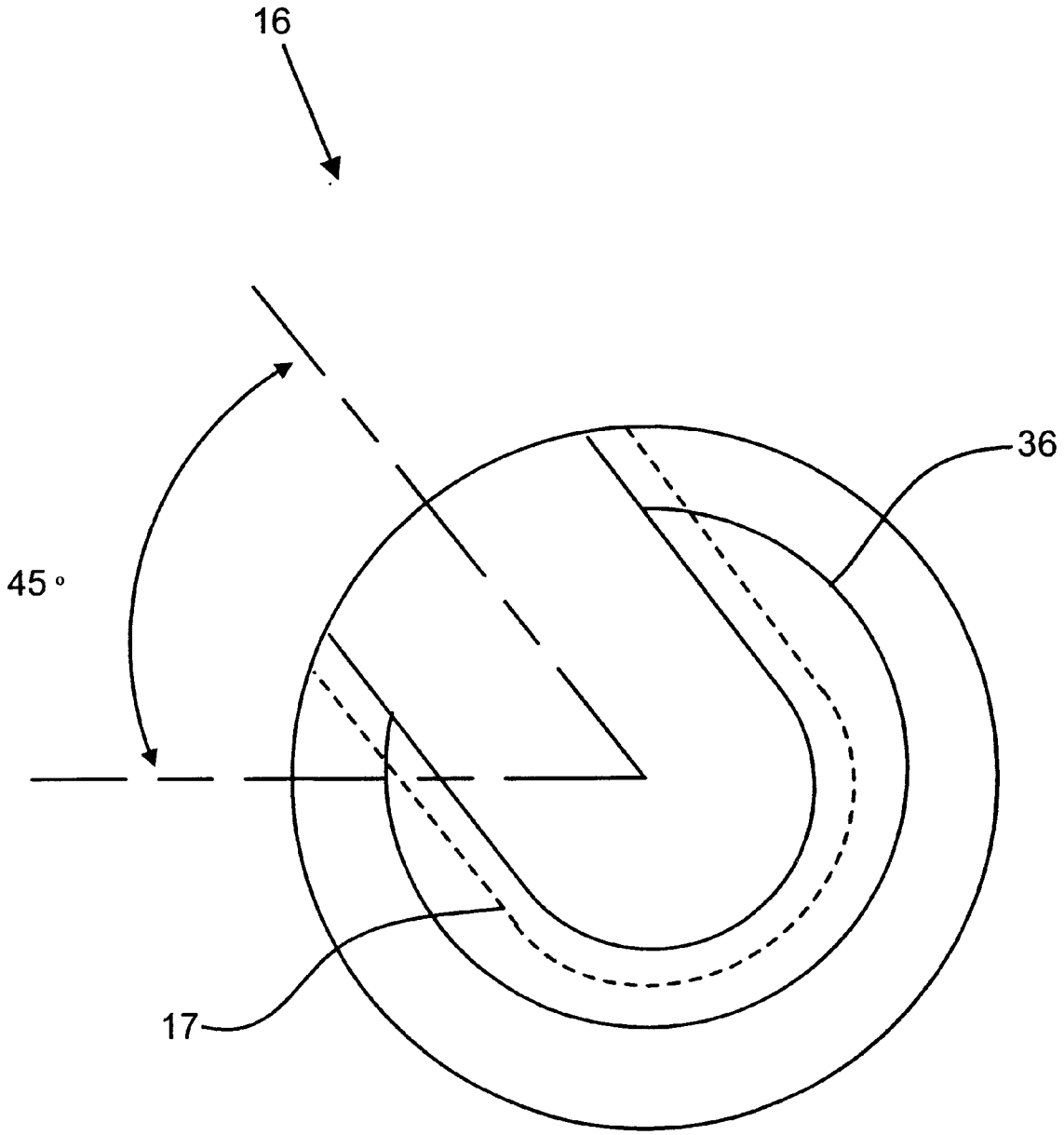
FIG. 4A is a breech-end view of the primer carrier for the firearm shown in FIG. 1 showing the horseshoe-shaped primer holder in a loading position.
Figure 4B:
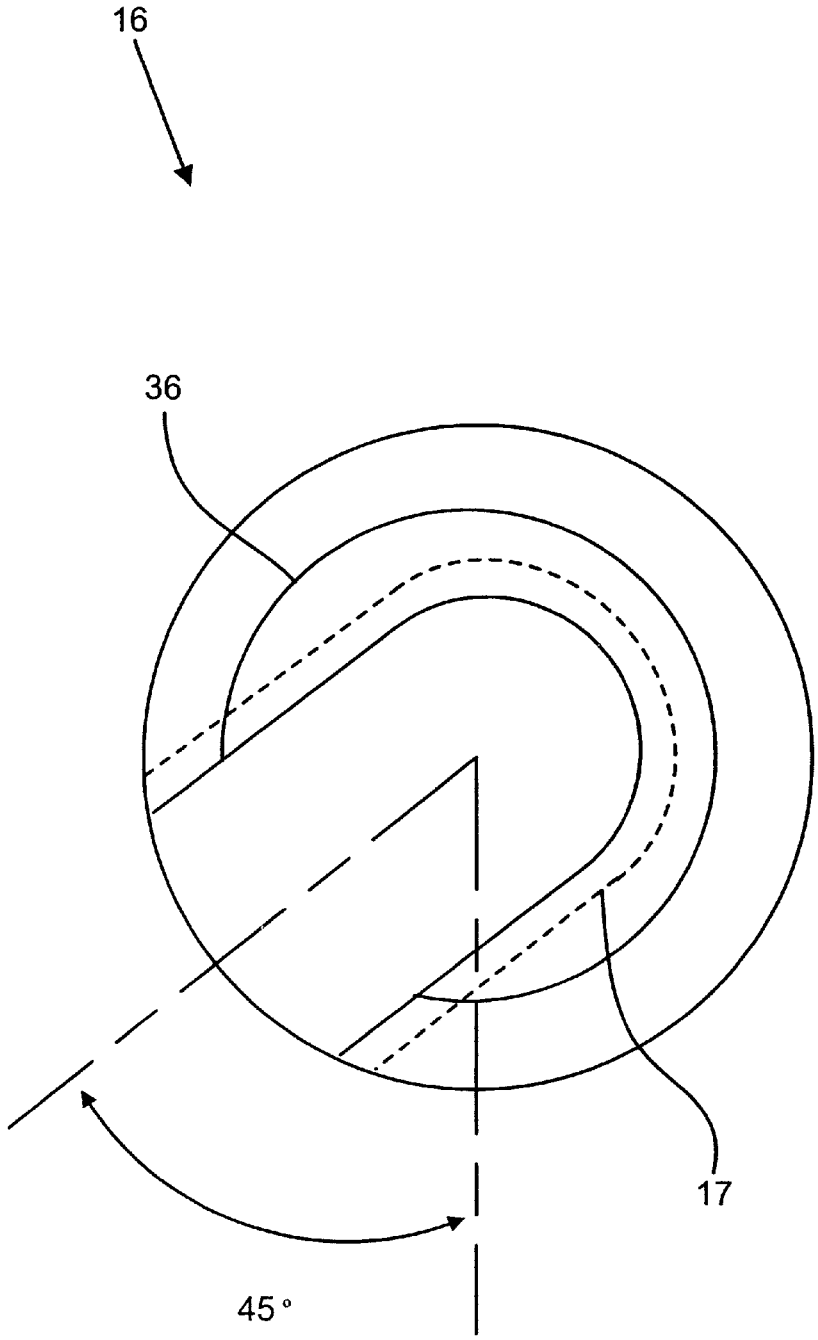
FIG. 4B is a breech-end view of the primer carrier for the firearm shown in FIG. 1 showing the horseshoe-shaped primer holder in a firing position.

As seen best in FIGS. 4A and 4B, the primer carrier 16 includes a horseshoe-shaped primer holder 17. The primer holder 17 is configured to receive a 209 shotgun primer. The head of a 209 shotgun primer is inserted through the open end of the primer holder 17 until the primer is concentrically aligned in the receiver/locking mechanism 12.

In operation, the primer carrier 16 is used to introduce a 209 shotgun primer into the breech plug 20 and set the primer in place in order to discharge the muzzle-loading weapon. The motion of the primer carrier 16 in the receiver/locking mechanism 12 is guided by the alignment guide 40 which engages a hardened socket head screw 50 having a hex socket. The backstop 46 on the alignment guide 40 stops against the screw 50 when the primer carrier 16 is in a fully retracted position. As the bolt 12*a* is pushed nearly filly forward and the handle 26 is rotated downward, the cam means 42 in the alignment guide 40 engages the screw 50 for presetting the primer in the primer receiving chamber 60 in the breech plug 20. As the handle is rotated filly downward to a locked position, the closing cam 44 takes pressure off the screw 50 and the primer carrier 16 fully sets the primer in a firing position.

To fire the firearm 10, the firearm is first loaded by inserting powder and a bullet into the barrel 14 and ramming the powder and bullet into the barrel and against the breech plug 20. The receiver/locking mechanism 12 is then opened by fully retracting the carrier 16. As best seen in FIG. 4A, in this position, the primer holder 17 is oriented about 45 degrees above horizontal and is openly accessible. A 209 shotgun primer is placed into the horseshoe-shaped primer holder 17. The primer is then delivered into the primer receiving chamber 60 in the breech plug 20 by forward movement of the primer carrier 16 and locking firearm as described above. In this firing position, the chamfer 36 on the primer carrier 16 engages the chamfered end of the primer collar 64, thereby enveloping the primer. As best seen in FIG. 4B, the open end of the primer holder 17 is oriented at about 45 degrees below horizontal in this firing position. In the event a primer prematurely discharges before the locking mechanism 12 is fully set, the safety vent holes 24 in the protective shroud 22 on the receiver 12*b* permit the resulting pressure to dissipate through the holes.

Once the firearm 10 is loaded and primed, the firearm is fired in a conventional manner by pulling a trigger (not shown), thereby causing the firing pin 56 to strike the primer (not shown). The struck primer produces a flame which travels through the flame bore 62 of the breech plug 20 and the vent liner 70 to ignite the powder in the barrel 14, thereby compelling the bullet from the barrel 14. The head on the vent liner 70 seats against the breech plug 20 and provides a seal 72 to protect the vent liner threads from the damaging effects of the powder ignition. Also, the breech plug thread protecting seal 74 acts to protect mating threads on the breech plug and barrel from the ignition. After firing the firearm, the receiver/locking mechanism 12 is opened by rotating the handle 26 upward and out of the receiver slot 30, and retracting the primer carrier 16 along the alignment guide 40 until the backstop 46 stops against the screw 50 at a full open position. The spent primer is then removed from the open end of the primer holder 17 and discarded. The firearm is then ready to reload.

Certain modifications and improvements will occur to those skilled in the art upon a reading of the foregoing description. By way of example, the receiver of the present invention is a bolt action receiver similar to designs used in other modern rifles. However, the invention is not limited to a bolt action firearm in its application, and other actions such as a lever action, rolling block, drop block, break action, or semi-automatic design could be utilized. It should be understood that all such modifications and improvements have been deleted herein for the sake of conciseness and readability but are properly within the scope of the following claims.

What is claimed:

1. A muzzle-loading firearm, said muzzle-loading firearm comprising:

(a) a receiver having a locking mechanism;

(b) a barrel having a breech end, a bore, a breech plug, and a muzzle end; and (c) a primer carrier integral with said locking mechanism for transporting a primer directly inserted into said primer carrier to said breech end of said barrel prior to firing and for extracting the primer from said breech end of said barrel after firing, whereby said primer carrier includes a chamfered edge for forming a metal to metal seal with said breech plug in the locked firing position.

2. The apparatus of claim 1, further including a breech plug in said breech end of said barrel, wherein said breech plug receives the primer from said primer carrier.

3. The apparatus of claim 2 wherein said breech plug further includes a nippleless primer receiving chamber and a flame bore extending from said chamber into said bore of said barrel.

4. The apparatus as claimed in claim 3 further including an outwardly extending primer collar on the breech plug.

5. The apparatus as claimed in claim 4 wherein said outwardly extending primer collar is radially symmetrical for random matching with said primer carrier.

6. The apparatus as claimed in claim 4 further including a chamfered end on said outwardly extending primer collar.

7. The apparatus as claimed in claim 6 wherein the chamfered end on said outwardly extending primer collar is radially symmetrical for random matching with said primer carrier.

8. The apparatus as claimed in claim 3 wherein said flame bore further includes a replaceable vent liner.

9. The apparatus as claimed in claim 8 further including a vent liner thread-protecting seal.

10. The apparatus as claimed in claim 2 wherein said breech plug is threaded for engagement with said barrel.

11. The apparatus as claimed in claim 10 wherein said breech plug further includes a breech plug thread protecting seal.

12. The apparatus as claimed in claim 2 wherein said breech plug has a circular cross section.

13. The apparatus as claimed in claim 2 wherein said breech plug further includes an installation tool mating surface.

14. The apparatus as claimed in claim 1 wherein said receiver further includes a protective shroud.

15. The apparatus as claimed in claim 14 wherein said protective shroud further includes one or more safety vent holes.

16. The apparatus as claimed in claim 1 wherein said receiver further includes a cocking indicator.

17. The apparatus as claimed in claim 1 wherein said locking mechanism includes a bolt, a bolt handle and a slot in said receiver for locking said bolt in a firing position.

18. The apparatus as claimed in claim 1 wherein said bore of said barrel is rifled.

19. The apparatus as claimed in claim 1 wherein said muzzle end of said barrel further includes a muzzle back bore.

20. The apparatus as claimed in claim 19 wherein said muzzle back bore has sufficient depth to provide engagement with the rear portion of a bullet inserted into said muzzle end of said barrel.

21. The apparatus as claimed in claim 20 wherein said muzzle back bore is sufficiently shallow to permit inspection of the front surface of the bullet inserted into said muzzle end of said barrel.

22. In an improved muzzle-loading firearm having a receiver including a locking mechanism; and a barrel having a breech end, a bore and a muzzle end, wherein said improvement comprises: a primer carrier integral with said locking mechanism for transporting a primer directly inserted into said primer carrier to said breech end of said barrel prior to firing and for extracting the primer from said breech end of said barrel after firing, said primer carrier including a horseshoe-shaped primer holder attached to said locking mechanism, whereby said primer carrier includes a chamfered edge for forming a metal to metal seal with said breech plug in the locked firing position.

23. The apparatus as claimed in claim 22 wherein said horseshoe-shaped primer holder includes a chamfered edge.

24. The apparatus as claimed in claim 22 wherein said horseshoe-shaped primer holder includes an open end oriented about forty-five degrees above horizontal in a loading position and about forty-five degrees below horizontal in a firing position.

25. The apparatus as claimed in claim 22 wherein said primer carrier further includes an alignment guide for aligning said primer carrier within said receiver.

26. The apparatus as claimed in claim 25 wherein said alignment guide further includes a cam means for presetting the primer at a firing position.

27. The apparatus as claimed in claim 26 wherein said receiver further includes a rear action screw and said locking mechanism further includes a closing cam for setting the primer at a firing position and relieving pressure on said rear action screw in said receiver.

28. The apparatus as claimed in claim 27 wherein said alignment guide further includes a backstop for limiting the rearward motion of the primer carrier in said receiver.

29. The apparatus as claimed in claim 28 wherein said rear action screw engages with said backstop on said alignment guide.

30. The apparatus as claimed in claim 29 wherein said rear action screw is a socket head screw constructed of a hardened material having a hex-shaped socket.

31. The apparatus as claimed in claim 22 wherein said locking mechanism further includes an extraction cam which cooperates with the primer carrier for extracting the primer after firing.

32. The apparatus as claimed in claim 22 wherein said primer carrier further includes a firing mechanism.

33. The apparatus as claimed in claim 32 wherein said firing mechanism includes a firing pin.

34. The apparatus as claimed in claim 33 wherein the outer diameter of said firing pin is sized for a blown primer.

35. A muzzle-loading firearms, said muzzle-loading firearm comprising:

(a) a receiver having a locking mechanism;

(b) a barrel having a breech end, a bore and a muzzle end;

(c) a primer carrier integral with said locking mechanism for transporting a primer directly inserted into said primer carrier to said breech end of said barrel prior to firing and for extracting the primer from said breech end of said barrel after firing, said primer carrier including a horseshoe-shaped primer holder attached to said locking mechanism; and (d) a breech plug in said breech end of said barrel, wherein said breech plug receives the primer from said primer carrier, whereby said primer carrier includes a chamfered edge for forming a metal to metal seal with said breech plug in the locked firing position.

36. The apparatus of claim 35 wherein said breech plug further includes a nippleless primer receiving chamber and a flame bore extending from said chamber into said bore of said barrel.

37. The apparatus as claimed in claim 36 further including an outwardly extending primer collar on the breech plug.

38. The apparatus as claimed in claim 37 wherein said outwardly extending primer collar is radially symmetrical for random matching with said primer carrier.

39. The apparatus as claimed in claim 37 further including a chamfered end on said outwardly extending primer collar.

40. The apparatus as claimed in claim 39 wherein the chamfered end on said outwardly extending primer collar is radially symmetrical for random matching with said primer carrier.

41. The apparatus as claimed in claim 36 wherein said flame bore further includes a replaceable vent liner.

42. The apparatus as claimed in claim 41 further including a vent liner thread-protecting seal.

43. The apparatus as claimed in claim 35 wherein said breech plug is threaded for engagement with said barrel.

44. The apparatus as claimed in claim 43 wherein said breech plug further includes a breech plug thread protecting seal.

45. The apparatus as claimed in claim 35 wherein said breech plug has a circular cross section.

46. The apparatus as claimed in claim 45 wherein said breech plug further includes an installation tool mating surface.

47. The apparatus as claimed in claim 35 wherein said receiver further includes a protective shroud.

48. The apparatus as claimed in claim 47 wherein said protective shroud further includes one or more safety vent holes.

49. The apparatus as claimed in claim 35 wherein said receiver further includes a cocking indicator.

50. The apparatus as claimed in claim 35 wherein said locking mechanism includes a bolt, a bolt handle and a slot in said receiver for locking said bolt in a firing position.

51. The apparatus as claimed in claim 35 wherein said bore of said barrel is rifled.

52. The apparatus as claimed in claim 35 wherein said muzzle end of said barrel further includes a muzzle back bore.

53. The apparatus as claimed in claim 52 wherein said muzzle back bore has sufficient depth to provide engagement with the rear portion of a bullet inserted into said muzzle end of said barrel.

54. The apparatus as claimed in claim 53 wherein said muzzle back bore is sufficiently shallow to permit inspection of the front surface of the bullet inserted into said muzzle end of said barrel.

55. The apparatus as claimed in claim 35 wherein said horseshoe-shaped primer holder includes a chamfered edge.

56. The apparatus as claimed in claim 35 wherein said horseshoe-shaped primer holder includes an open end oriented about forty-five degrees above horizontal in a loading position and about forty-five degrees below horizontal in a firing position.

57. The apparatus as claimed in claim 35 wherein said primer carrier further includes an alignment guide for aligning said primer carrier within said receiver.

58. The apparatus as claimed in claim 57 wherein said alignment guide further including a cam means for presetting the primer at a firing position.

59. The apparatus as claimed in claim 58 wherein said receiver further includes a rear action screw and said locking mechanism further includes a closing cam for setting the primer at a firing position and relieving pressure on the rear action screw in said receiver.

60. The apparatus as claimed in claim 57 wherein said alignment guide further includes a backstop for limiting the rearward motion of the primer carrier in said receiver.

61. The apparatus as claimed in claim 60 wherein said rear action screw engages with said backstop on said alignment guide.

62. The apparatus as claimed in claim 61 wherein said rear action screw is a socket head screw constructed of a hardened material having a hex-shaped socket.

63. The apparatus as claimed in claim 35 wherein said locking mechanism further includes an extraction cam which cooperates with the primer carrier for extracting the primer after firing.

64. The apparatus as claimed in claim 35 wherein said primer carrier further includes a firing mechanism.

65. The apparatus as claimed in claim 64 wherein said firing mechanism includes a firing pin.

66. The apparatus as claimed in claim 65 wherein the outer diameter of said firing pin is sized for a blown primer.

* * * * *